US008330656B2

(12) United States Patent
Chiu

(10) Patent No.: US 8,330,656 B2
(45) Date of Patent: Dec. 11, 2012

(54) ELECTRONIC DEVICE AND FIXING STRUCTURE THEREOF

(75) Inventor: Yi-Tsung Chiu, Tao Yuan Shien (TW)

(73) Assignee: Quanta Computer Inc., Kuei Shan Hsian, Tao Yuan Shien (TW)

( * ) Notice: Subject to any disclaimer, the term of this patent is extended or adjusted under 35 U.S.C. 154(b) by 635 days.

(21) Appl. No.: 12/545,985

(22) Filed: Aug. 24, 2009

(65) Prior Publication Data

US 2010/0277375 A1 Nov. 4, 2010

(30) Foreign Application Priority Data

Apr. 29, 2009 (TW) ..... 98207231 U

(51) Int. Cl.
*H01Q 1/24* (2006.01)

(52) U.S. Cl. ..... 343/702; 343/878

(58) Field of Classification Search ..... 343/702, 343/878

See application file for complete search history.

(56) References Cited

U.S. PATENT DOCUMENTS 7,705,790 B2 * 4/2010 Booth et al. ..... 343/702
2007/0115187 A1 * 5/2007 Zhang et al. ..... 343/702

* cited by examiner

*Primary Examiner* — Hoang V Nguyen
*Assistant Examiner* — Kyana R McCain
(74) *Attorney, Agent, or Firm* — McClure, Qualey & Rodack, LLP

(57) ABSTRACT

An electronic device and a fixing module are provided. The electronic device further includes a housing and an antenna module. The antenna module includes an antenna, a first engaging portion and a second engaging portion. The first engaging portion and the second engaging portion are installed on two ends of the antenna. The first engaging portion includes an upper surface. The fixing module installed on the housing includes a first limiting element and a second limiting element. When the antenna module is fixed with the fixing module, the first limiting element is engaged with the first engaging portion, and the second limiting element is engaged with the second limiting element. The first limiting element includes a protrusion. When the antenna module is fixed with the fixing module, the protrusion covers the upper surface of the first engaging portion.

16 Claims, 5 Drawing Sheets

ELECTRONIC DEVICE AND FIXING STRUCTURE THEREOF

CROSS REFERENCE TO RELATED APPLICATIONS

This Application claims priority of Taiwan Patent Application No. 098207231, filed on Apr. 29, 2009, the entirety of which is incorporated by reference herein.

BACKGROUND OF THE INVENTION

1. Field of the Invention

The invention relates to an electronic device, and more particularly to an electronic device with an antenna and a fixing structure.

2. Description of the Related Art

FIG. 1 is a schematic view of an antenna module and a fixing structure of a conventional electronic device (for example a notebook computer). With wireless network cards popularly used, the antenna has already become a basic element of conventional electronic devices. Currently, the kinds of wireless network cards of an electronic device comprise WLAN, wireless technology (for example, 3G and 3.5 G), Bluetooth and GPS. Besides, parts of the wireless network cards above may use more than one antenna to improve receipt of signals (i.e. each wireless network card may be electronically operated with more than one antenna). Thus, more screws are required for installation, resulting in longer assembly time and increased costs.

Referring to FIG. 1, the assembling method of the antenna module 11 and the fixing structure 12 of the conventional electronic device 10 is shown in FIG. 1. The antenna module 11 comprises an antenna 111, a first engaging portion 112 and a second engaging portion 113. The first engaging portion 112 and the second engaging portion 113 have through holes. The fixing structure 12 is disposed on a housing 13 of the electronic device 10 and comprises a first limiting portion, a second limiting portion (for example a hole, not shown) respectively corresponding to the first engaging portion 112, the second engaging portion 113 and screws 121 and 122. The antenna module 11 of the conventional electronic device 10 is fixed with the fixing structure 12 by using the screws 121 and 122 to pass through the through holes on the first engaging portion 112 and the second engaging portion 113, and the holes on the first limiting portion and the second limiting portion. Thus, if the conventional electronic device 10 has three antenna modules, six screws must be provided for fixation, resulting in longer assembly time and increased costs.

BRIEF SUMMARY OF THE INVENTION

The invention provides an electronic device. The electronic device comprises a housing, an antenna module and a fixing structure. The antenna comprises an antenna, a first engaging portion and a second engaging portion. The first engaging portion and the second engaging portion are installed on two ends of the antenna. The first engaging portion comprises an upper surface and a side surface. The fixing structure is disposed on the housing and comprises a first limiting portion, a second limiting portion, and a third limiting portion. The first limiting portion comprises a protrusion. When the antenna is fixed with the fixing module, the first limiting element is engaged with the first engaging portion to limit the antenna module from moving in a first direction. The protrusion covers the upper surface of the first engaging portion to limit the antenna module from moving in a second direction perpendicular to the first direction. The third limiting element props the side surface to limit the antenna module from moving in a third direction perpendicular to the first direction and the second direction. The second limiting element is engaged with the second limiting element to limit the antenna module from rotating along a plane defined by the first direction and the third direction.

Note that the second limiting portion comprises a supporting portion and a first fixing portion. The second engaging portion comprises a second fixing portion. The first fixing portion is fixed with the second fixing portion.

Note that the first fixing portion is a protrusion. The second fixing portion is a through hole. The supporting portion is crisscross shaped.

Note that the fixing structure further comprises a fourth limiting portion disposed on an opposite surface of the side surface propped by the third limiting portion to limit the antenna module from moving in the second direction.

Note that the fixing structure further comprises a fifth limiting portion disposed at an interval from the third limiting portion to support the first engaging portion.

Note that the third limiting portion is T shaped.

Note that the first limiting portion is L shaped.

Note that the protrusion is higher than the upper surface.

BRIEF DESCRIPTION OF DRAWINGS

The invention can be more fully understood by reading the subsequent detailed description and examples with references made to the accompanying drawings, wherein.

The invention can be more fully understood by reading the subsequent detailed description and examples with references made to the accompanying drawings.

DETAILED DESCRIPTION OF THE INVENTION

Figure 1:
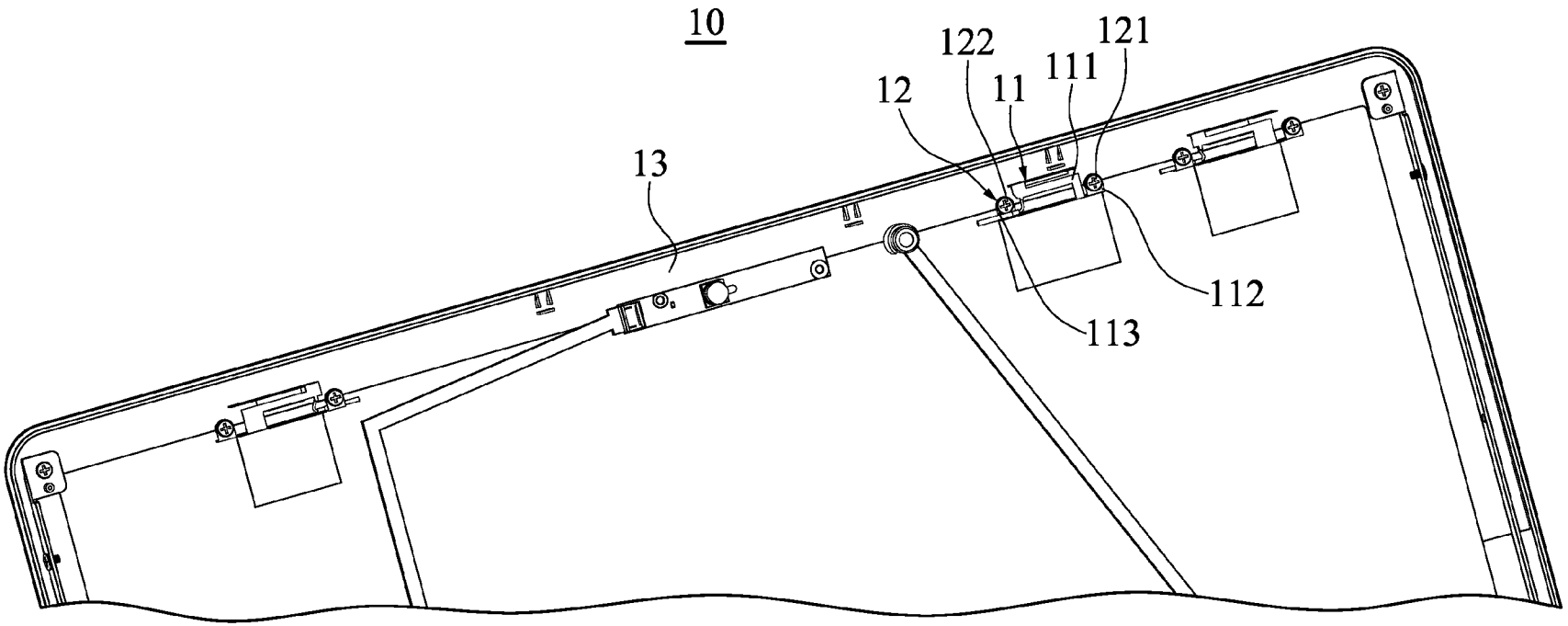
FIG. 1 is a schematic view of an antenna module and a fixing structure of a conventional electronic device.
Figure 2:
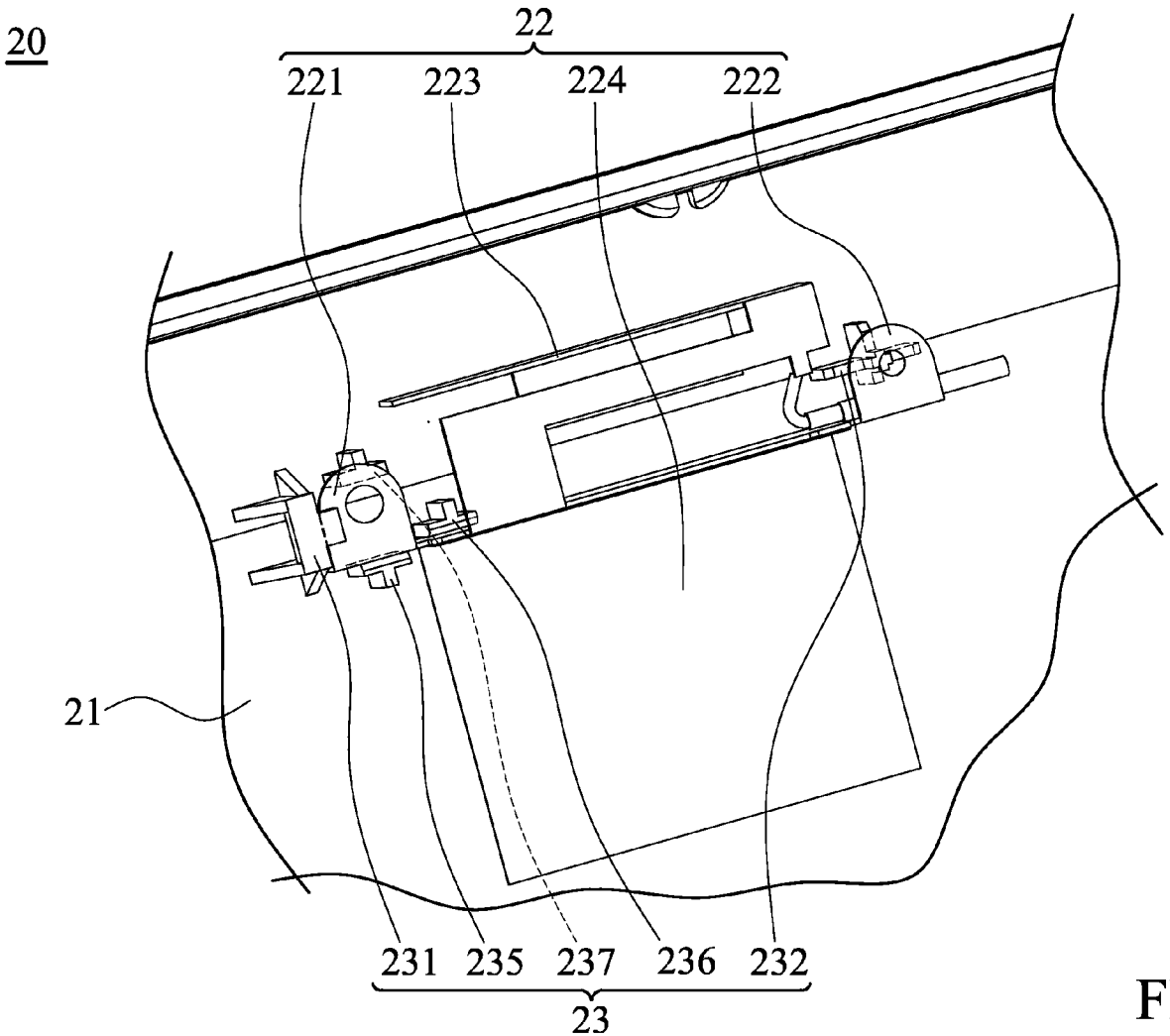
FIG. 2 is a vertical view showing an antenna module and a fixing structure of an electronic device of the invention.
Figure 3:
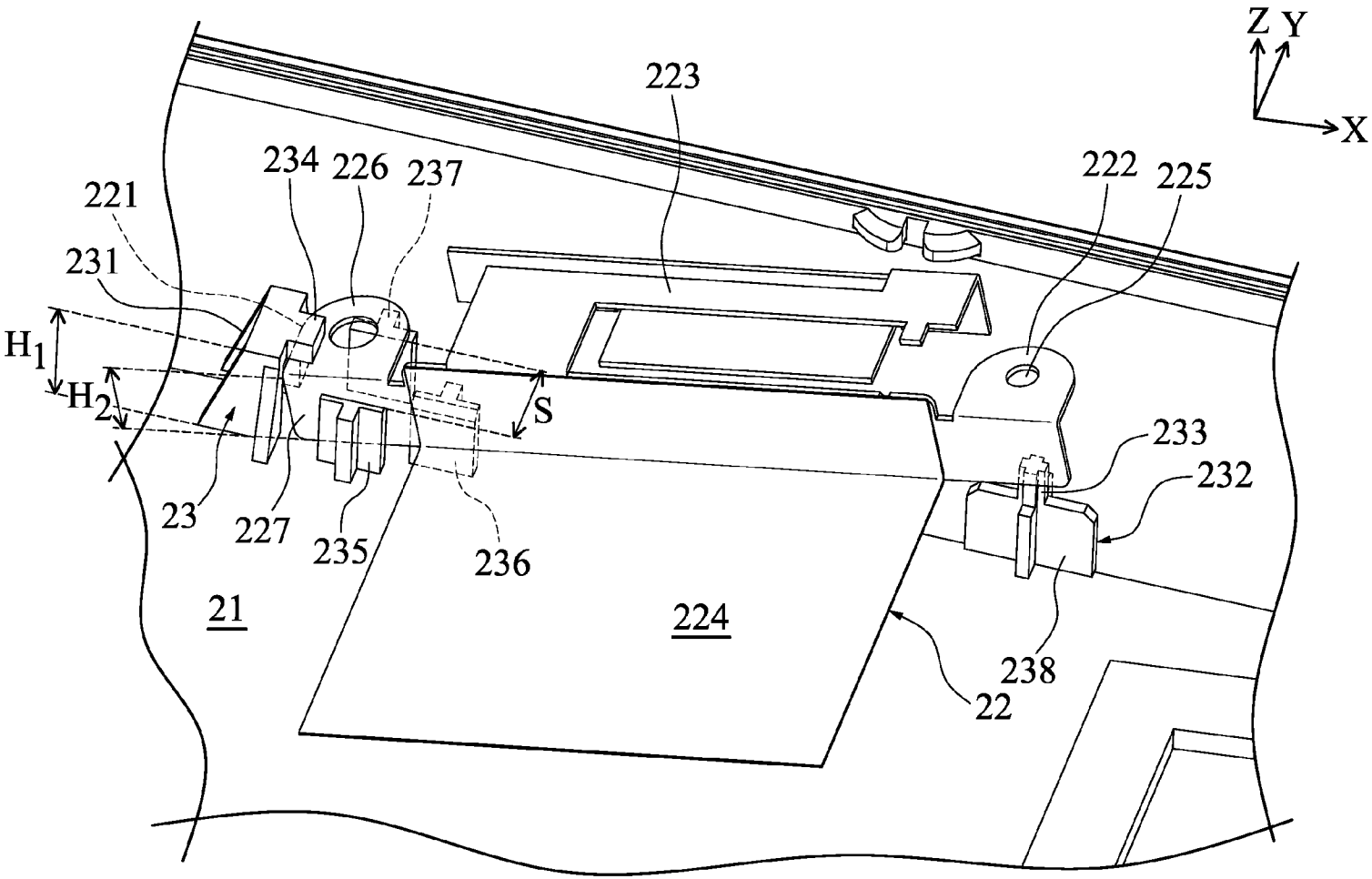
FIG. 3 is a schematic view showing an antenna module being assembled with a fixing structure of an electronic device of the invention.
Figure 4:
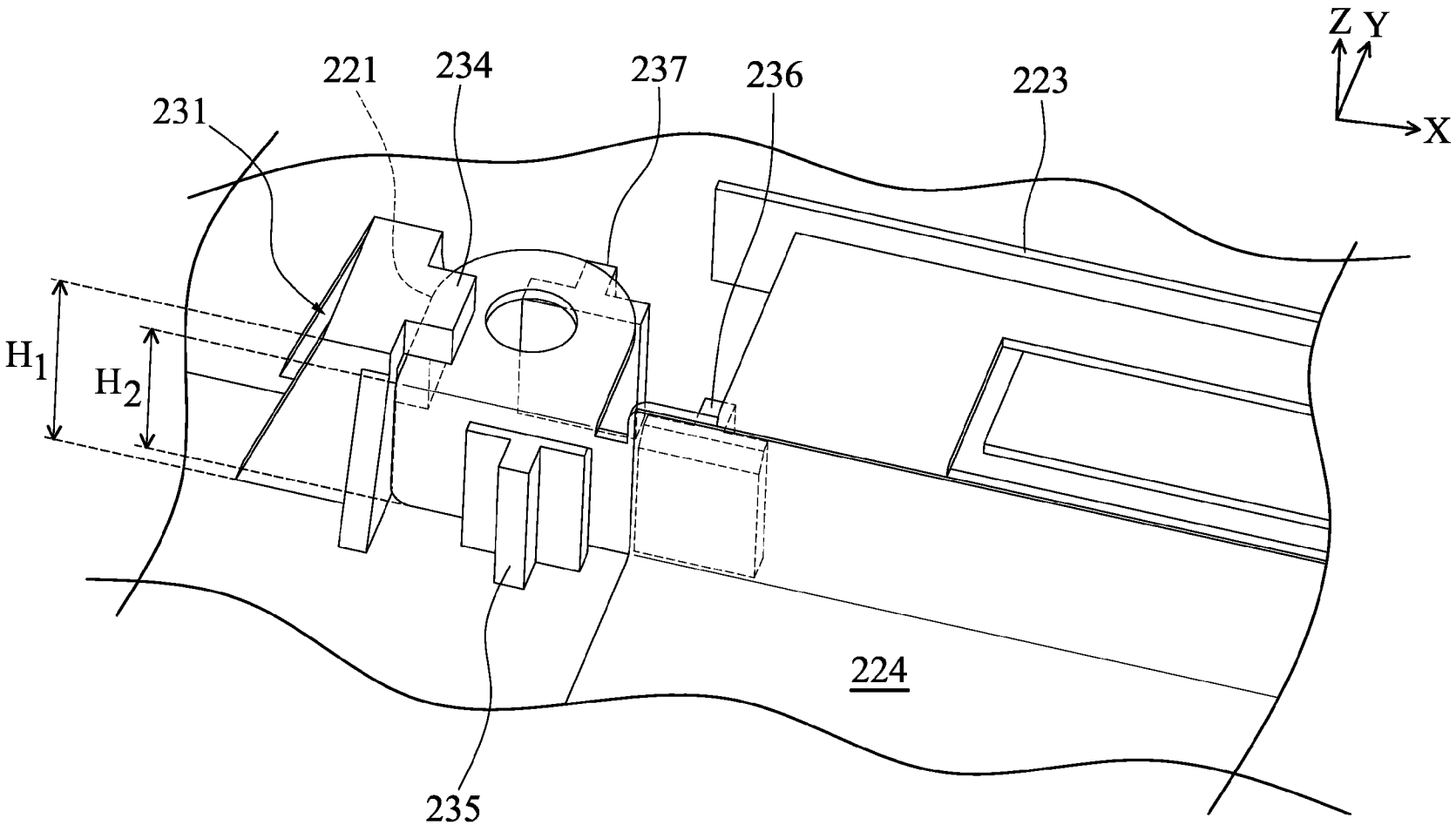
FIG. 4 is a schematic view showing a first engaging portion and a first limiting portion of an electronic device of the invention.
Figure 5:
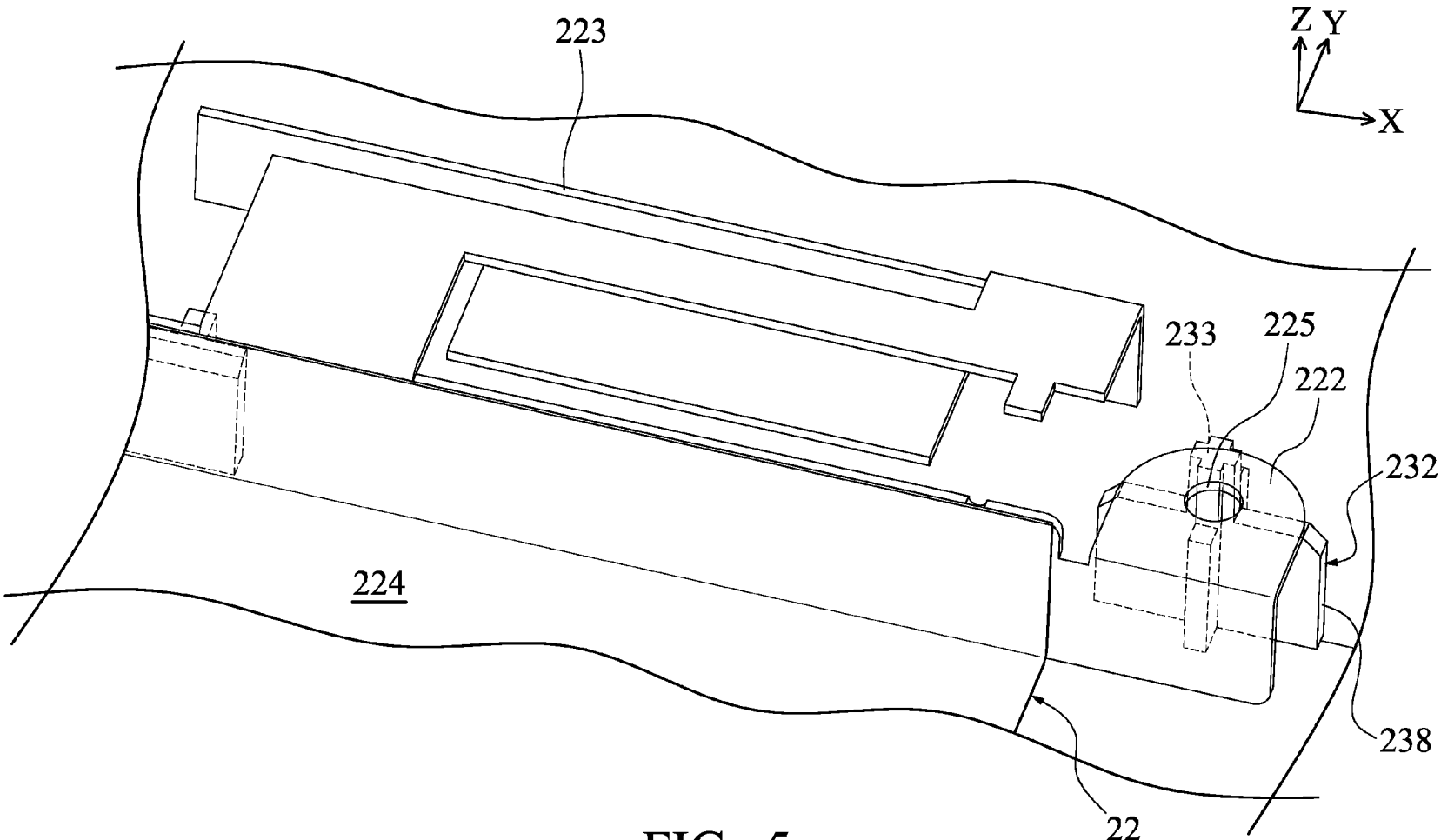
FIG. 5 is a schematic view showing a second engaging portion and a second limiting portion of an electronic device of the invention.

FIG. 2 is a vertical view showing an antenna module and a fixing structure of an electronic device of the invention. FIG. 3 is a schematic view showing an antenna module being assembled with a fixing structure of an electronic device of the invention. FIG. 4 is a schematic view showing a first engaging portion and a first limiting portion of an electronic device of the invention. FIG. 5 is a schematic view showing a second engaging portion and a second limiting portion of an electronic device of the invention. In this embodiment, an electronic device of the invention, for example a mobile internet device, MID, of a laptop or a notebook, or a cell phone etc., has an antenna module.

Referring to FIGS. 2 to 5, the electronic device 20 comprises a housing 21, an antenna module 22 and a fixing structure 23. The fixing structure 23 and the housing could be forming together into a single member. The antenna module 22 utilizes the fixing structure 23 for assembly with the housing 21.

The antenna module 22 comprises an antenna 223, a first engaging portion 221, and a ground portion 224. The first engaging portion 221 and the second engaging portion 222 are disposed on two ends of the antenna 223. The ground portion 224 is connected to the antenna 223. The first engaging portion 221 comprises an upper surface 226 and a side surface 227. In this embodiment, the upper surface 226 is perpendicularly connected to the side surface 227. The first engaging portion 221 is L shaped.

The fixing structure 23 comprises a first limiting portion 231, a second limiting portion 232 and a third limiting portion 235. When the antenna module 22 is assembled with the fixing structure 23, the second limiting portion 232 is engaged with the second engaging portion 222, and the first limiting portion 231 and the third limiting portion 235 are fixed to the first engaging portion 221. The third limiting portion 235 props the side surface 227. Besides, a fourth limiting portion 236 is provided optionally to further limit the movement of the first engaging portion 221. Furthermore, the fixing structure 23 further comprises a fifth limiting portion 237 to support the first engaging portion 221.

The first limiting portion 231 is L shaped and comprises a protrusion 234. When the antenna module 22 is fixed to the fixing structure 23, the protrusion 234 covers the upper surface 226 of the first engaging portion 221. The second limiting portion 232 comprises a supporting portion 238 and a first fixing portion 233. The second engaging portion 222 comprises a second fixing portion 225. The first fixing portion 233 is engaged with the second fixing portion 225, thus, the second limiting portion 232 limits the second engaging portion 222 to rotate on an XY plane. In this embodiment, the first fixing portion 233 is a protrusion. The second fixing portion 225 is a hole. The supporting portion 238 is crisscross shaped to enhance the structural strength. The third limiting portion 235 is T shaped and is formed on the housing 21 corresponding to the first engaging portion 221.

Referring to FIG. 3, when the antenna module 22 is assembled with the fixing structure 23, at first, the antenna module 22 is slanted slightly, and the first engaging portion 221 is pushed under the protrusion 234. Then, the hole of the second fixing portion 225 on the second engaging portion 222 engages with the protrusion of the first fixing portion 233 for fixation. The height $H_1$ of the protrusion 234 is higher than the height $H_2$ of the upper surface 226.

After the antenna module 22 is assembled with the fixing structure 23, referring to FIGS. 4 and 5, the first engaging portion 221 utilizes the first limiting portion 231 and the second limiting portion 232 to limit the antenna module 22 from moving in an X direction relative to the fixing structure 23. The first engaging portion 221 utilizes the third limiting portion 235 and the second limiting portion 232 to limit the antenna module 22 from moving in a Y direction relative to the fixing structure 23. The first engaging portion 221 utilizes the protrusion 234 to limit the antenna module 22 from moving in a Z direction relative to the fixing structure 23. Besides, the fourth limiting portion 236, cooperated with the third limiting portion 235 and the second limiting portion 232, is optionally provided to limit the antenna module 22 from moving in the Y direction relative to the fixing structure 23. The fifth limiting portion 237 is optionally disposed to support the first engaging portion 221. The fourth limiting portion 236 is T shaped and is disposed on an opposite surface of the side surface 227 propped by the third limiting portion 235. The fifth limiting portion 237 and the third limiting portion 235 are disposed at an interval S.

The antenna module 22 and the fixing structure 23 of the electronic device 20 provides a simple structure to make the antenna module 22 fixed to the fixing structure 23 from moving in the X, Y and Z directions. Compared with the conventional electronic device, the antenna module 22 and the fixing structure 23 of the electronic device 20 of the invention does not require screws, thus, time required for assembly of screws is saved and costs are decreased.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fixing structure, for fixing an antenna module, wherein the antenna module comprises an antenna, a first engaging portion and a second engaging portion, the first engaging portion and the second engaging portion are installed on two ends of the antenna, and the first engaging portion comprises an upper surface and a side surface, comprising:

a first limiting portion, comprising a protrusion;

a second limiting portion; and a third limiting portion;

wherein when the antenna is fixed with the fixing structure, the first limiting portion is engaged with the first engaging portion to limit the antenna module from moving in a first direction; the first engaging portion is under the protrusion, and the upper surface of the first engaging portion is pushed by the protrusion to limit the antenna module from moving in a second direction perpendicular to the first direction; the second limiting portion is engaged with the second engaging portion to limit the antenna module from rotation; and the third limiting portion props the side surface to limit the antenna module from moving in a third direction perpendicular to the first direction and the second direction;

wherein the second limiting portion comprises a supporting portion and a first fixing portion, the second engaging portion comprises a second fixing portion, and the first fixing portion is engaged with the second fixing portion;

wherein the first fixing portion is a protrusion, the second fixing portion is a through hole, and the supporting portion is crisscross shaped.

2. The fixing structure as claimed in claim 1, further comprising a fourth limiting portion disposed on an opposite surface of the side surface propped by the third limiting portion for limiting the antenna module from moving in the second direction.

3. The fixing structure claimed in claim 1, further comprising a fifth limiting portion disposed at an interval from the third limiting portion for supporting the first engaging portion.

4. The fixing structure claimed in claim 1, wherein the third limiting portion is T shaped.

5. The fixing structure claimed in claim 1, wherein the first limiting portion is L shaped.

6. The fixing structure claimed in claim 1, wherein the protrusion is higher than the upper surface.

7. An electronic apparatus, comprising:

a housing;

an antenna module, comprising an antenna, a first engaging portion and a second engaging portion, wherein the first engaging portion and the second engaging portion are installed on two ends of the antenna, and the first engaging portion comprises an upper surface and a side surface; and a fixing structure, disposed on the housing and comprising a first limiting portion, a second limiting portion, and a third limiting portion, the first limiting portion having a protrusion;

wherein the antenna is fixed with the fixing structure, the first limiting portion is engaged with the first engaging portion to limit the antenna module from moving in a first direction; the first engaging portion is under the protrusion, and the upper surface of the first engaging portion is pushed by the protrusion to limit the antenna module from moving in a second direction perpendicular to the first direction; the second limiting portion is engaged with the second engaging portion to limit the antenna module from rotation; and the third limiting portion props the side surface to limit the antenna module from moving in a third direction perpendicular to the first direction and the second direction;

wherein the second limiting portion comprises a supporting portion and a first fixing portion, the second engaging portion comprises a second fixing portion, and the first fixing portion is engaged with the second fixing portion;

wherein the first fixing portion is a protrusion, the second fixing portion is a through hole, and the supporting portion is crisscross shaped.

8. The electronic apparatus claimed in claim 7, wherein the fixing structure further comprises a fourth limiting portion disposed on an opposite surface of the side surface propped by the third limiting portion for limiting the antenna module from moving in the second direction.

9. The electronic apparatus claimed in claim 7, wherein the fixing structure further comprises a fifth limiting portion disposed at an interval from the third limiting portion for supporting the first engaging portion.

10. The electronic apparatus claimed in claim 7, wherein the third limiting portion is T shaped.

11. The electronic apparatus claimed in claim 7, wherein the first limiting portion is L shaped.

12. The electronic apparatus claimed in claim 7, wherein the protrusion is higher than the upper surface.

13. The electronic apparatus claimed in claim 7, wherein the fixing structure further comprises a fourth limiting portion disposed on an opposite surface of the side surface propped by the third limiting portion to limit the antenna module from moving in the second direction.

14. The electronic apparatus claimed in claim 13, wherein the fixing structure further comprises a fifth limiting portion disposed at an interval from the third limiting portion for supporting the first engaging portion.

15. The electronic apparatus claimed in claim 14, wherein the third limiting portion is T shaped.

16. The electronic apparatus claimed in claim 15, wherein the protrusion is higher than the upper surface.

* * * * *